US008302977B1

(12) United States Patent
Crutchfield

(10) Patent No.: US 8,302,977 B1
(45) Date of Patent: Nov. 6, 2012

(54) FLEXIBLE SKATEBOARD TRUCK

(76) Inventor: Patrick Elton Q. Crutchfield, Denver, CO (US)

( * ) Notice: Subject to any disclaimer, the term of this patent is extended or adjusted under 35 U.S.C. 154(b) by 381 days.

(21) Appl. No.: 12/387,614

(22) Filed: May 4, 2009

Related U.S. Application Data

(60) Provisional application No. 61/197,266, filed on Oct. 24, 2008.

(51) Int. Cl.
*B62M 1/00* (2010.01)

(52) U.S. Cl. ..... 280/87.042; 280/87.03

(58) Field of Classification Search ..... 280/87.042, 280/87.03, 11.27, 11.28, 11.26, 11.19
See application file for complete search history.

(56) References Cited

U.S. PATENT DOCUMENTS 326,540 A * 9/1885 Baker ..... 280/11.19
457,129 A * 8/1891 Masterson ..... 280/11.26
3,774,924 A * 11/1973 Machatsch ..... 280/11.28
4,152,001 A 5/1979 Christianson
4,184,693 A * 1/1980 Whitmarsh ..... 280/11.28
4,251,087 A * 2/1981 Hansen ..... 280/11.28
4,398,735 A * 8/1983 Evans et al. ..... 280/11.28
5,474,314 A * 12/1995 Lehman ..... 280/87.042
6,224,076 B1 5/2001 Kent
6,367,819 B1 4/2002 Anderson et al.
7,896,364 B1 * 3/2011 Ferreira ..... 280/11.27

* cited by examiner

*Primary Examiner* — Hau Phan

(57) ABSTRACT

A Flexible Skateboard Truck intended to provide improved shock absorption and maneuverability consists of a monocoque and an axle whereby a connection is made between a mass and a device capable of moving across a surface. Said monocoque consists of flexible material which can be repeatedly deformed and returned to its original, constructed shape. Applied pressure and shock is absorbed and momentarily stored as energy by said monocoque whose instantaneous, controlled release by the rider steers said Flexible Skateboard Truck. The mounting points are configured to allow for stability and flexibility. Additional compressive support can be introduced by the insertion of a pneumatic bladder or bladders. An optional slit or slits and rib or ribs can be introduced in order to facilitate steering.

2 Claims, 13 Drawing Sheets

FLEXIBLE SKATEBOARD TRUCK

CROSS-REFERENCE TO RELATED APPLICATIONS

This application claims the benefit of Provisional Patent Application No. 61/197,266, filed Oct. 24, 2008 by the present applicant, Patrick E. Q. Crutchfield. (Said Provisional Patent Application contains photographs of working models of the Flexible Skateboard Truck.)

FEDERALLY SPONSORED RESEARCH

None

SEQUENCE LISTING OR PROGRAM

None

BACKGROUND

1. Field

This application generally relates to skateboards, specifically to a skateboard truck. A truck is attached to the bottom of a skateboard deck. The truck forms a suspension device between a skateboard deck upon which a rider stands and wheels which provide the ability for the skateboard assembly to roll across a plane.

A traditional skateboard truck is an assemblage of mostly metal parts. These parts include a baseplate, hanger, grommets, kingpin, nut and elastomeric bushings.

All embodiments presented in this application omit these traditional skateboard truck parts. A single monococular suspension structure replaces all traditional parts with the exception of an axle.

2. Prior Art

A traditional skateboard consists of a deck, two trucks, two axles, four wheels and eight bearings and is used for transportation, physical exertion, and entertainment and is an activity referred to as skateboarding. Skateboards originated in California in the late 1950's and by the mid 1960's were mass produced and sold throughout the United States. At the present time they are used in many parts of the world.

Conventional skateboard trucks currently utilize an assemblage of mostly metal parts including baseplates, hangers, grommets, kingpins and nuts. Bushings are made of elastomeric, somewhat resilient materials. The configuration of a traditional assembly consists of a three section alignment of said parts. The baseplate is attached to the skateboard deck. Beneath the baseplate is the hanger which contains the axle. Between the hanger and baseplate are bushings. The bushings permit a limited ability to turn, very limited shock absorption and almost no ability to store energy. The assembly is held together by the kingpin passing through the hanger, bushing and baseplate. The nut secures the assembly.

A traditional skateboard is propelled by downhill gravity or by pumping with one foot while the other foot remains on the skateboard. The skateboard is steered by shifting weight to one side or the other of the deck misaligning the two axles creating an arc defined by the intersection of the axle axes. The skateboard rotates around this intersection. Abrupt turns and tricks are accomplished by forcing one or more of the wheels off the ground and jerking the skateboard into a new direction. The rider accomplishes skateboard maneuvers by abruptly forcing a combination of wheels to take less load or leave the ground altogether. Sudden thrusting, twisting and shifting of weight destabilize inertia causing a change in vertical and/or horizontal direction known as a trick. Not only is the rider required to absorb most of the shock forces, but also steering and maneuverability are confined to a series of forceful jerks and compensatory movements to realign and stabilize the ride.

Skateboard steering, maneuverability and safety are able to be improved by reconsidering skateboard truck design altogether in order to achieve improved energy storage, shock absorption and more responsive steering. Skateboard trucks that have been designed to address shock absorption become complex. Complexity makes their assemblies more vulnerable to failure. Due to a reduction of manufacturing techniques, the simpler, monococular, Flexible Skateboard Truck will be easier to model and test and less expensive to fabricate.

The embodiments discussed in this application describe a one piece, flexible, monococular suspension structure which replaces all traditional truck components with the exception of the axle. The Flexible Skateboard Truck allows greater latitude of steering, superior shock absorption and more dynamic release of energy. This promotes better maneuverability and provides superior safety than the currently used rigid skateboard truck components. Said truck is lighter thus requiring less energy to propel. Through the release of stored energy within the truck, maneuverability is improved thus yielding an enhanced and more satisfying ride for the operator. Functional and operational models of several of the embodiments described herein can be demonstrated thus verifying this statement.

The concept of a monocoque, which originates in nature, has been utilized in human design endeavors for centuries and commercial purposes since the 1930's. Monocoques can be observed in devices including but not limited to cocoons, eggs and other natural shells, automobile and aircraft bodies, bicycle frames, buildings, wind engine blades and the like. Monocoques are outer shells intended to resist and absorb stress and provide resistance and/or protection from a variety of forces. Said Flexible Skateboard Truck's design, like a traditional skateboard truck, utilizes the application of forces and stresses to achieve steering. Because said Flexible Skateboard Truck has the ability to store and release more energy redirected in a wider range, steering as well as shock absorption and overall maneuverability are enhanced.

A search for patents that describe a monocoque designed to form a skateboard truck yields no results. However, other approaches to improving skateboard shock absorption and steering have been taken and are described and discussed as follows:

U.S. Pat. No. 6,367,819, The Shock Absorbing Skateboard Truck utilizes a shock absorber member constructed of several parts to provide shock absorption. This assemblage of parts appears to be very similar to traditional skateboard trucks which feature one set of shock absorbing elements (grommets and bushings). However, a second shock absorbing member has been introduced into this truck's kingpin assembly. Because of the additional shock absorbing member, the hanger is allowed to pivot around the kingpin with diminished resistance. This may add some additional shock absorption but at the cost of loosening the steering. Traditional trucks depend on a stiff to very stiff assembly of elements around the kingpin to prevent fishtailing and general loss of control.

Embodiments discussed in this application describe a one piece, flexible, monococular suspension structure forming the Flexible Skateboard Truck. Said truck promotes wider latitude of steering, superior shock absorption and a controllable release of energy. This results in more advanced maneuverability and provides increased safety. Said truck is lighter thus requiring less energy to propel. Through controlled release of stored energy within the monocoque, maneuverability is improved thus yielding an enhanced and more satisfying ride for the operator.

U.S. Pat. No. 6,224,076, The Pneumatic Compression Strut Skateboard Truck, achieves shock absorption and maneuverability by utilizing an extensive assemblage of parts including pneumatic compression struts in conjunction with coiled compression springs.

Embodiments in this application, in lieu of utilizing an extensive assemblage of parts, employs a single, flexible, monococular structure whose function it is to absorb shock and store energy whose release is controlled by the rider. Energy storage and maneuverability occurs when the Flexible Skateboard Truck deforms in shape. This creates many stress combinations that are dynamically released by the rider. Additional support can be achieved by inserting a fixed or variable pressure pneumatic bladder(s) positioned between the skateboard deck and in inside surface of the monocoque. The pneumatic design, depicted in FIG. 12, Drawing Numeral 23, increases shock absorption and modifies energy storage. This allows adaptation of various rider weights and riding styles.

U.S. Pat. No. 4,152,001, Skateboard Truck utilizes an "S" shaped leaf spring, axle carrying member, transverse axle, pin and coiled spring assembly, support block and bushings which appear to address the issues of suspension and steering. In order to turn, the rider shifts his weight on the skateboard deck misaligning the axles to form a turning radius. Instead of lateral forces misaligning the two axles to form a turning radius, each "S" shaped leaf spring may tend to roll over. Although the skateboard deck would tilt, a limited turning radius would be developed. Therefore the skateboard would tend to continue moving in a straight line. This rolling over of the "S" spring would at least to some degree absorb weight change thus contradicting the purpose of the pin and spring assembly whose purpose it seems to be to form a mechanism for steering.

The monococular truck design depicted in this application provides a simplified means for steering, shock absorption and overall suspension in a unitary structure. Said monococular design reduces weight and cost of manufacture while at the same time increasing rider control, safety and reliability.

SUMMARY

In accordance with one embodiment a monocoque comprises a suspension device in which an axle is mounted to form a connection between a mass and a wheel or wheels.

DRAWINGS

Figures

DRAWINGS

Reference Numbers

Figure 1:
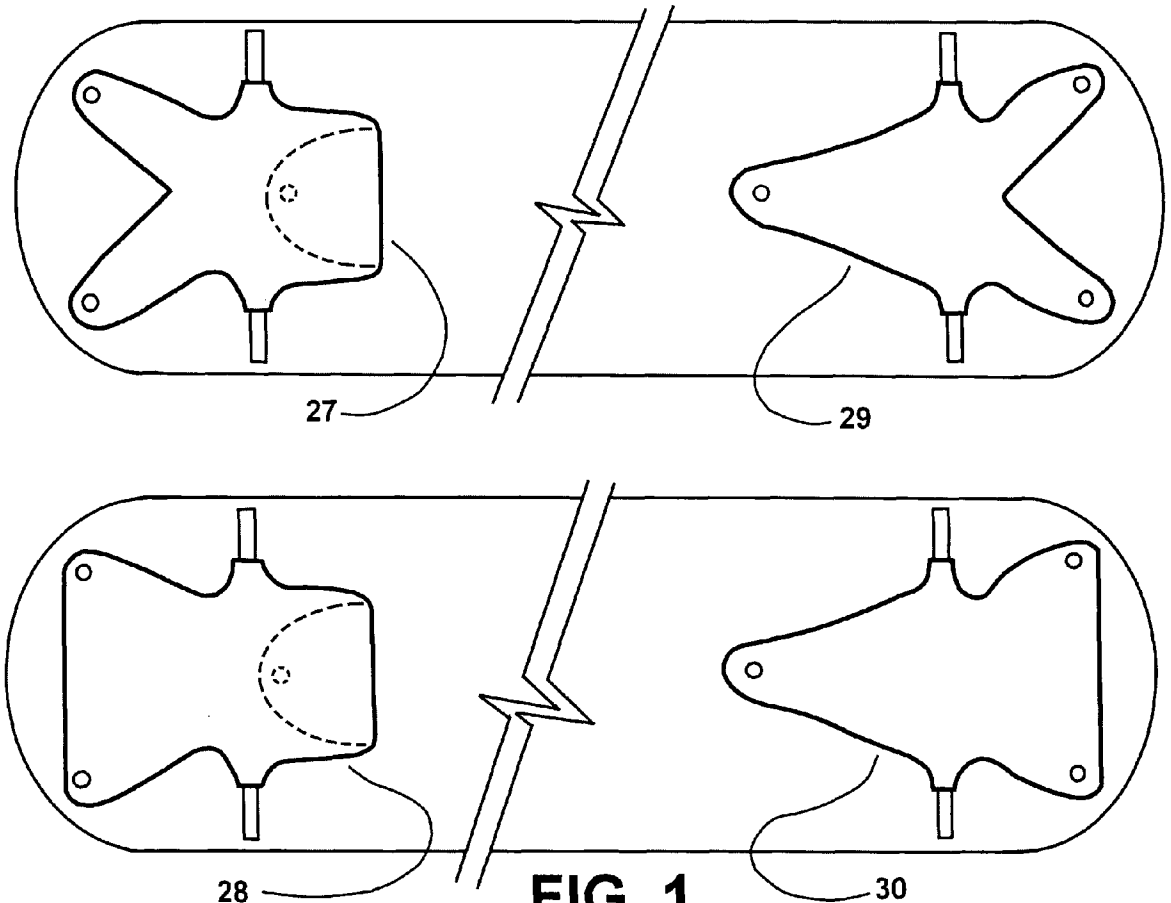
FIG. 1 is a bottom view of four embodiments described in this application and bearing Reference Numbers 27, 28, 29 and 30 in the following DRAWINGS—Reference Numbers section presented immediately following this section.

14. Extended, unitary distal leg
15. Not used
16. Medial leg curved over
17. Extended distal legs
18. Axle
19. Attachment points
20. Not used
21. Slits and/or ribs
22. Extended medial leg
23. Pneumatic bladder
24. Skateboard deck
25. Wheels
26. Pneumatic valve
27. Embodiment One
28. Embodiment Two
29. Embodiment Three
30. Embodiment Four

DETAILED DESCRIPTIONS

The First Embodiment of the Flexible Skateboard Truck is illustrated in FIG. 1, Number 27 and FIGS. 2, 3, 4 and 5.

FIG. 1, Number 27 is a bottom view showing a possible orientation of the single truck to a skateboard itself. This embodiment can be combined with another unit of the same embodiment or with other embodiments.

Figure 2:
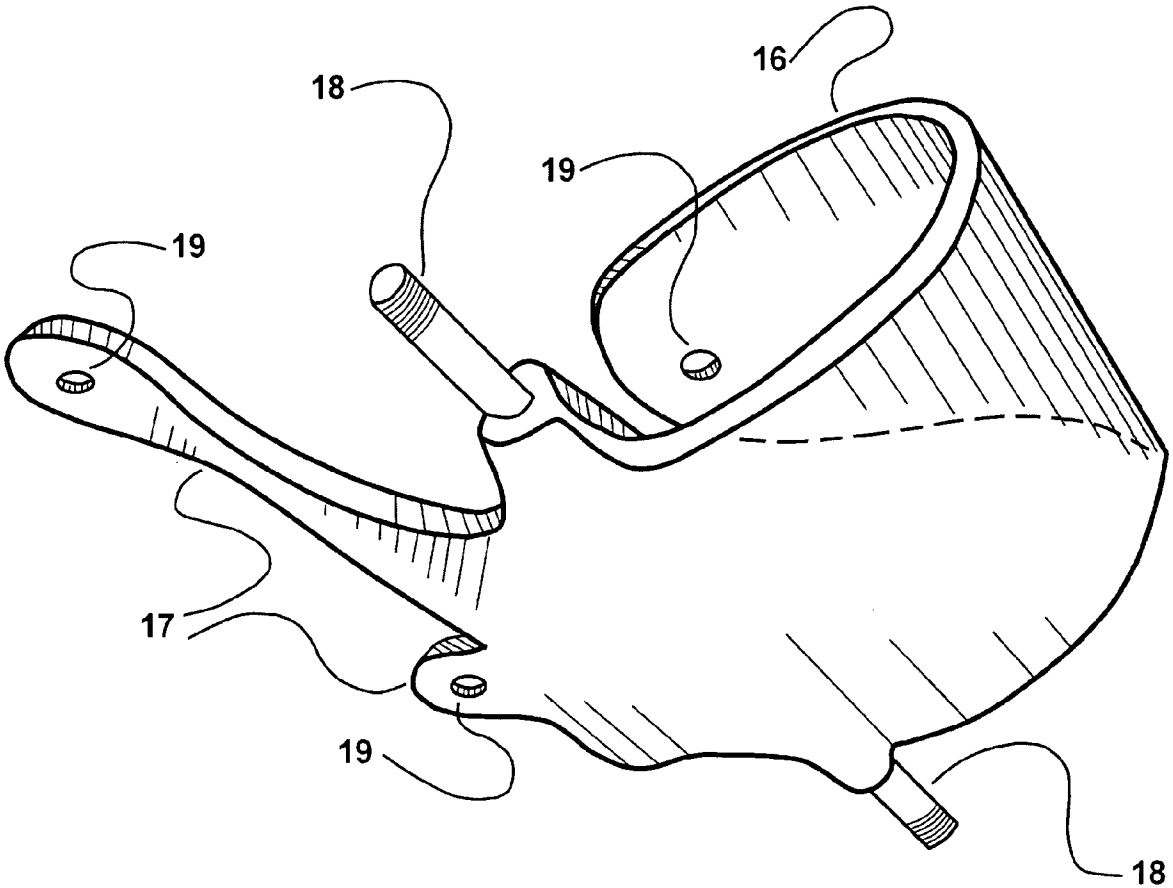
FIG. 2 is a bottom perspective view of Embodiment One. Said embodiment (Reference Number 27) features a skateboard truck with a single, curved-over, medial leg (leg pointing to the center of the skateboard) and two extended distal legs (legs pointing to the outside front or rear edges of a skateboard deck).

FIG. 2 is a bottom perspective view of the First Embodiment. A single medial leg (16) is shown curved over itself. Two distal legs (17) forming a "Y" extend outward. This creates an arched, tripartite, monococular Flexible Skateboard Truck. The crown of said truck contains an axle (18). Said truck is mounted to the skateboard deck at one or more possible points (19).

Figure 3:
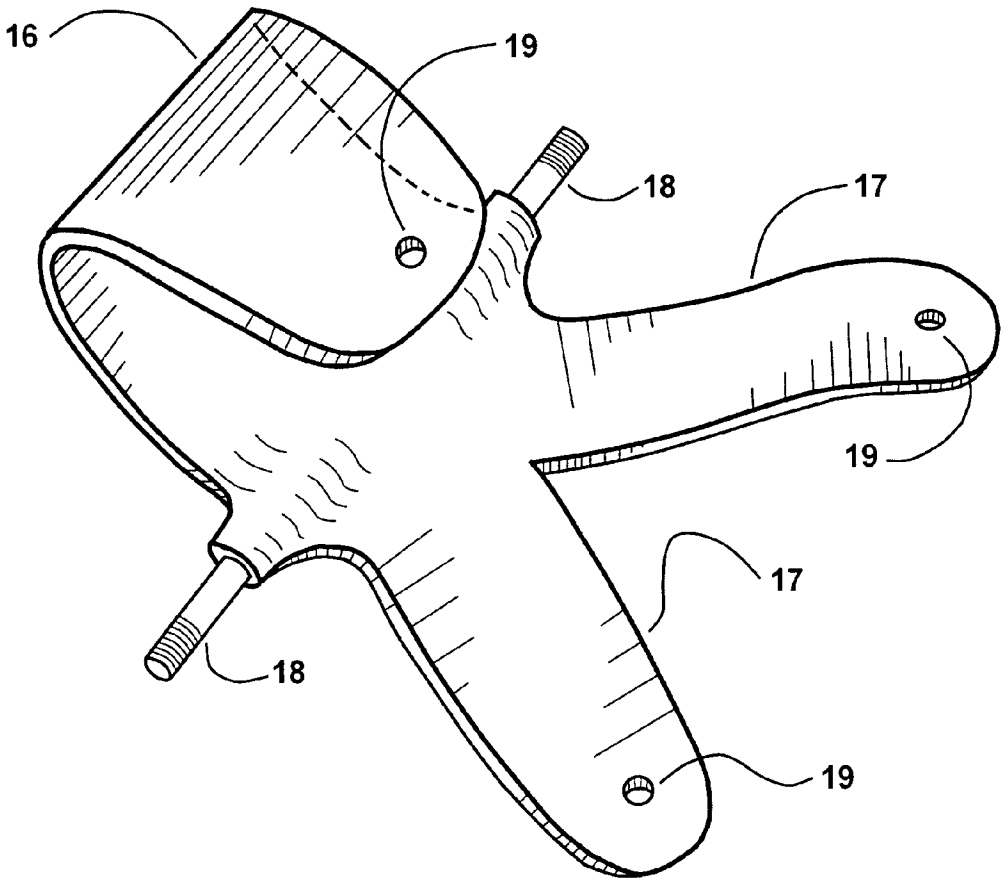
FIG. 3 is a top perspective view of Embodiment One (Reference Number 27) which features one curved-over medial leg and two extended distal legs of a skateboard truck.

FIG. 3 is a top perspective view of the First Embodiment. A single medial leg (16) is shown curved over itself. Two distal legs (17) forming a "Y" extend outward. This creates an arched, tripartite, monocoque. The crown of said monocoque contains an axle (18). Said truck is mounted to a skateboard deck at one or more possible points (19). The Flexible Skateboard Truck can be constructed integrally with a mass attached at one or more points and consisting of the same or different materials as said truck.

Figure 4:
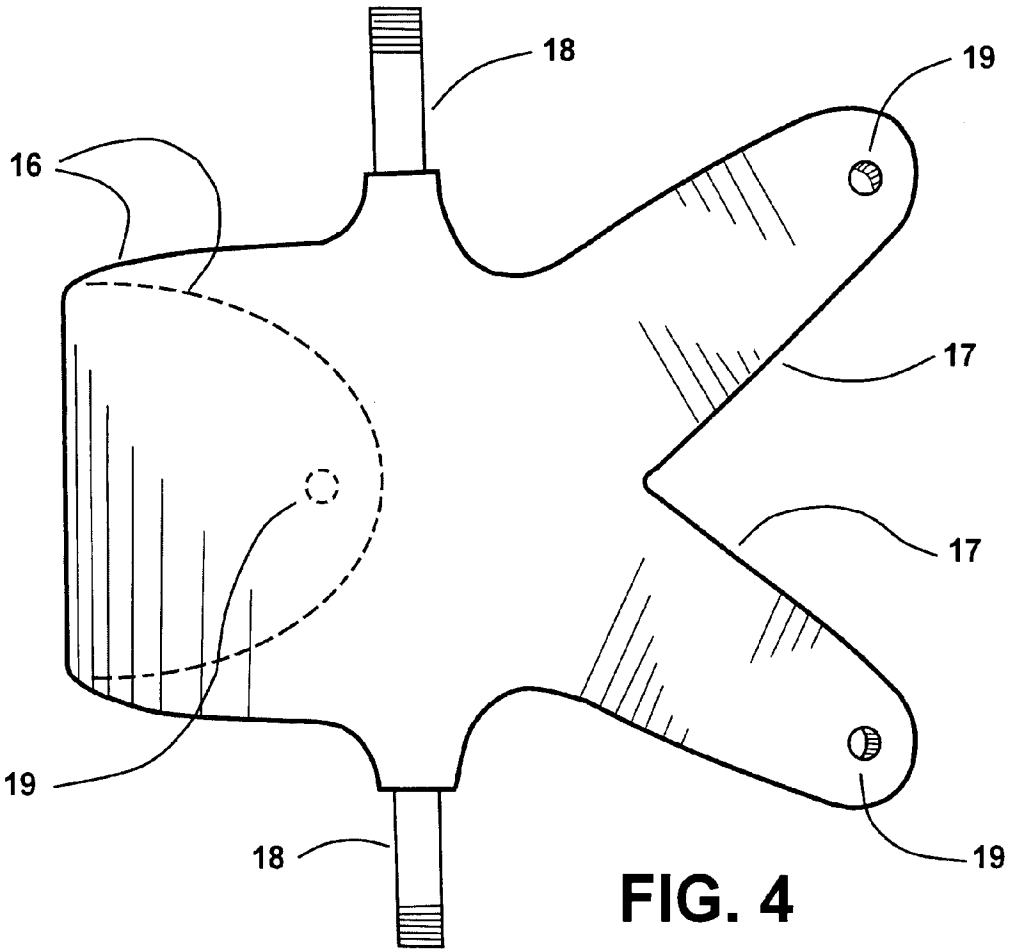
FIG. 4 is a bottom view of Embodiment One (Reference Number 27) with the single, medial leg curving over and shown as a single dashed line.

FIG. 4 is a top view of the first embodiment showing possible locations of mounting points (19). A single medial leg (16) is shown curved over itself and is depicted as a dashed line. Two distal legs (17) forming a "Y" extend outward. This creates an arched, tripartite, monococular Flexible Skateboard Truck. The crown of said truck contains an axle (18).

Figure 5:
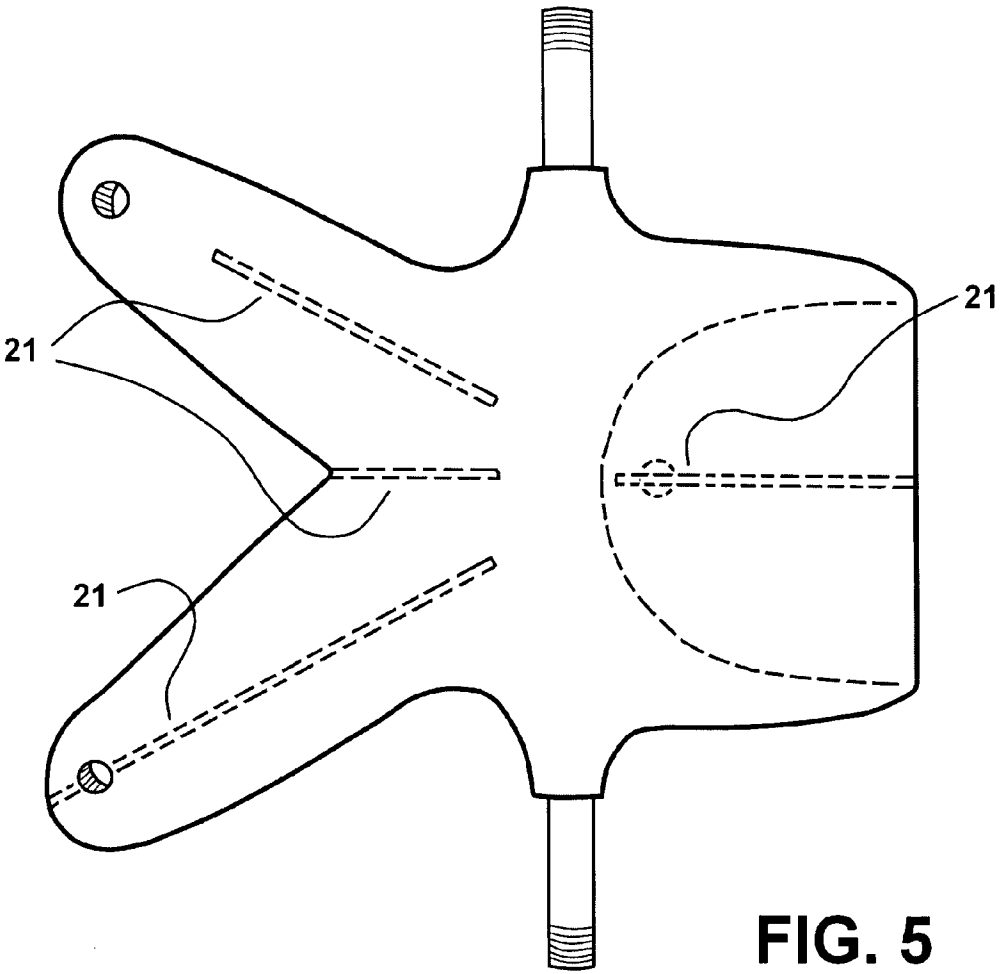
FIG. 5 is a bottom view of Embodiment One depicting possible slit and/or rib placements shown as doubled dashed lines.

FIG. 5 is a bottom view of the first embodiment illustrating possible locations of slits and/or ribs (21) shown as doubled straight, dashed lines. Curved and/or straight slits and/or ribs can be introduced in a variety of locations in any of the four embodiments described in this application. A single, medial leg is shown curved over itself and is depicted as a single, curved, dashed line. The two distal legs forming a "Y" extend outward. This creates an arched, tripartite monocoque. The crown of said monocoque contains an axle.

Because the operation of all four embodiments is similar, OPERATION is described at the end of this section, DETAILED DECSRIPTIONS.

Figure 6:
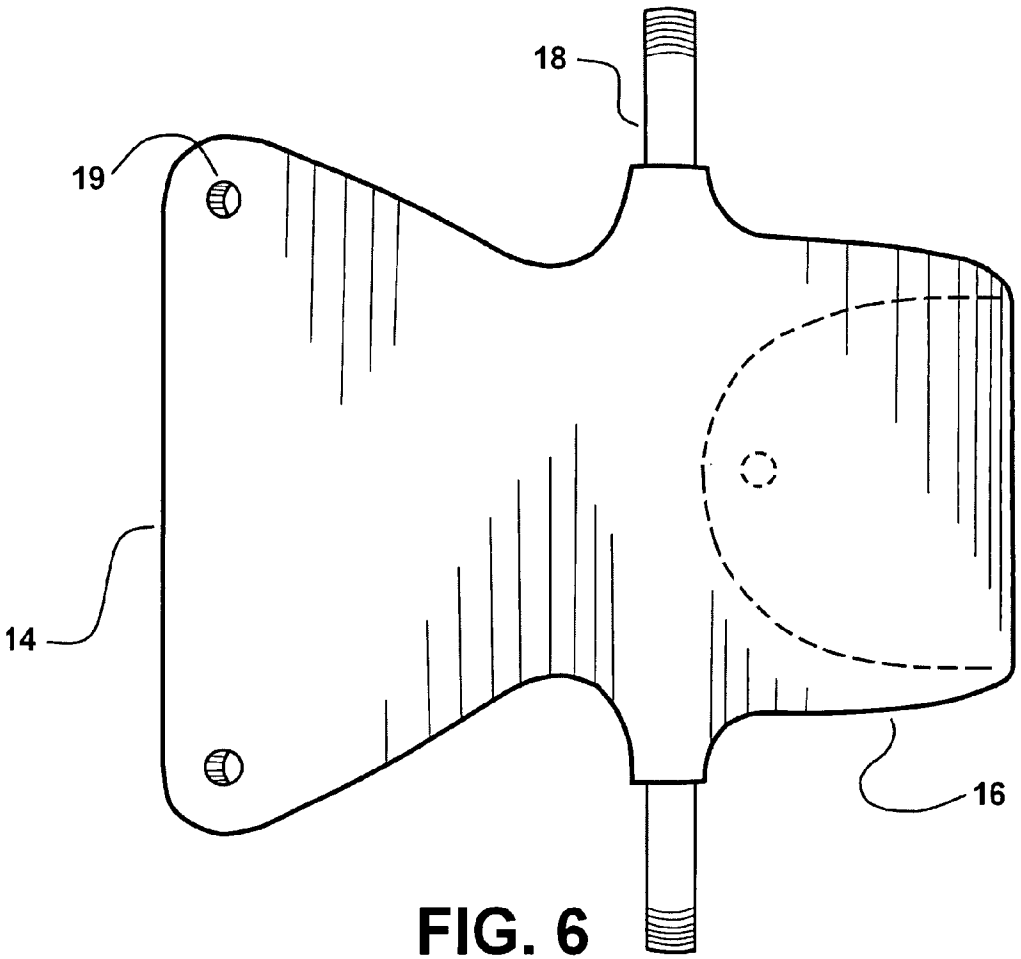
FIG. 6 is a bottom view of Embodiment Two (Reference Number 28) depicting a single, unitary distal leg.

The Second Embodiment of a Flexible Skateboard Truck is illustrated in FIG. 1, Number 28 and FIG. 6.

FIG. 6 is a bottom view of the Second Embodiment. A distal leg (14) is depicted as a single unit. Said medial leg (16) is shown curved over itself as a single, dashed line. The distal leg combined with the medial leg form an arched monococular Flexible Skateboard Truck. The crown of said truck contains an axle (18). Said truck is mounted to a skateboard deck at one or more possible mounting points (19). The Flexible Skateboard Truck can be constructed integrally with a mass consisting of the same or different materials as said truck.

Because the operation of all four embodiments is similar, OPERATION is described at the end of this section, DETAILED DECSRIPTIONS.

Figure 7:
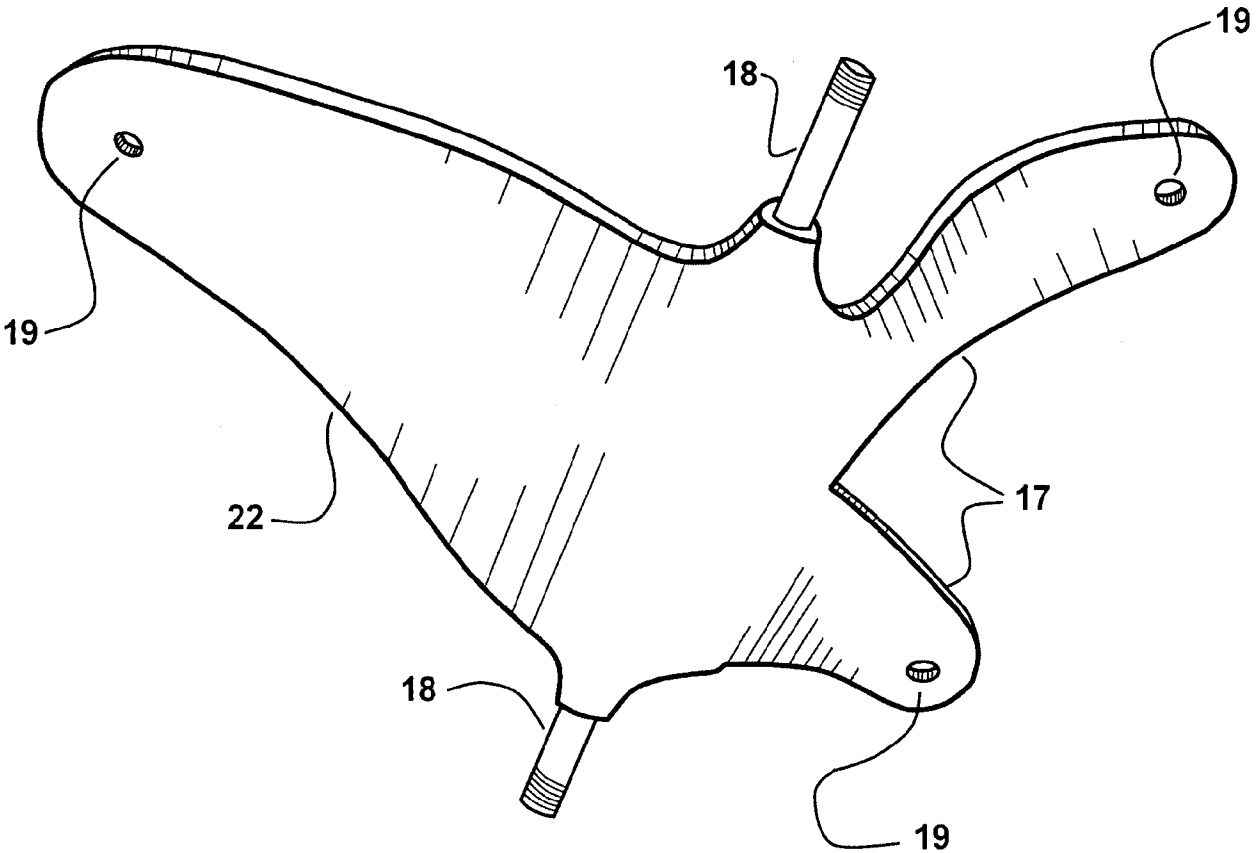
FIG. 7 is a bottom perspective of Embodiment Three (Reference Number 29) depicting a medial extended leg and two extended distal legs of a skateboard truck.

The Third Embodiment of the Flexible Skateboard Truck is illustrated in FIG. 1, Number 29 and FIG. 7.

FIG. 7 is a bottom perspective view of the Third Embodiment. A single medial leg (22) is shown extended. Two distal legs (17), forming a "Y", extend outward. This creates an arched, tripartite, monococular Flexible Skateboard Truck. The crown of said truck contains an axle (18). Said truck is mounted to the skateboard deck at one or more possible points (19). The Flexible Skateboard Truck can be constructed integrally with a mass consisting of the same or different materials as said truck.

Figure 8:
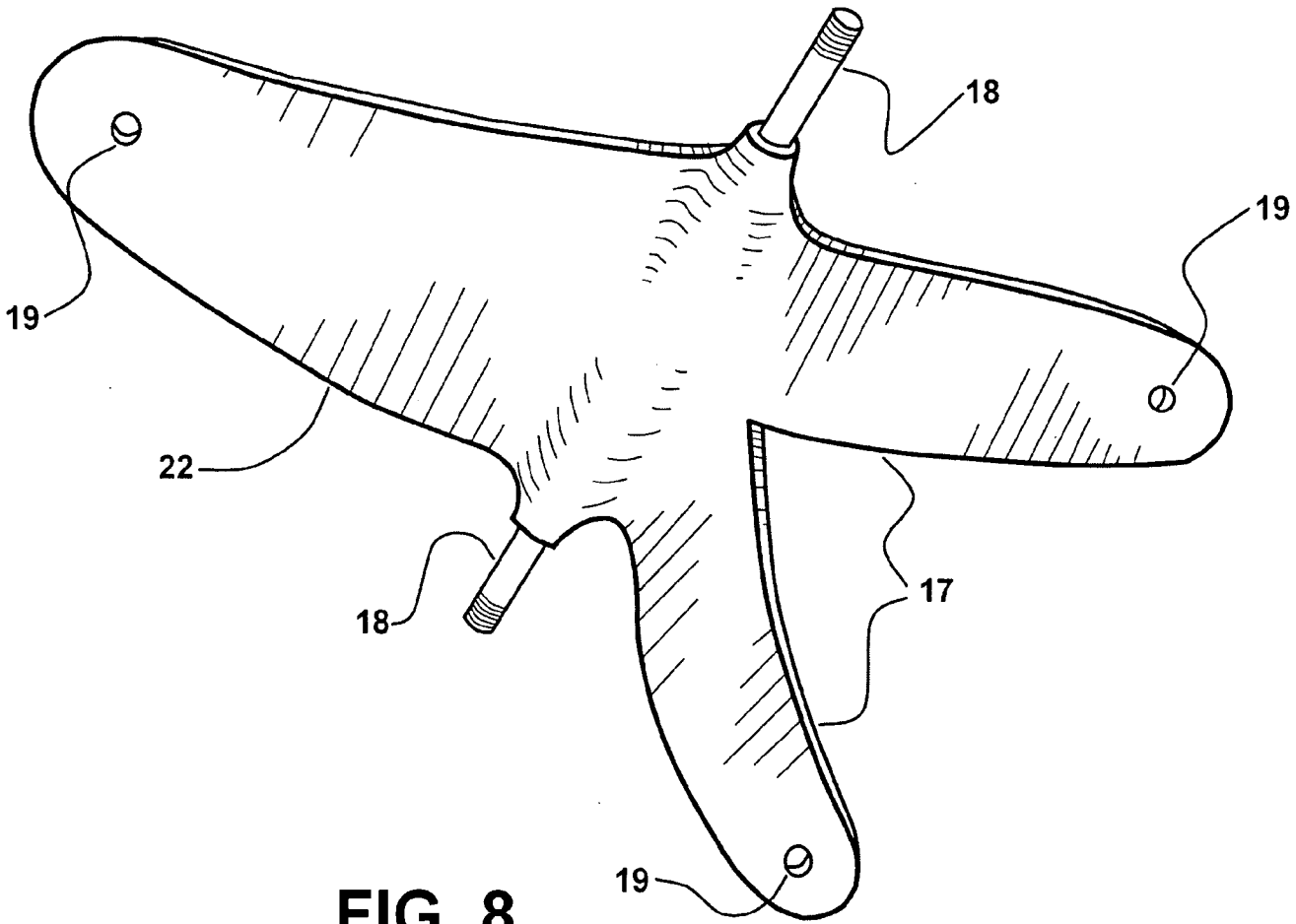
FIG. 8 is a top perspective of Embodiment Three (Reference Number 29) depicting the medial extended leg and two extended distal legs of a skateboard truck.

FIG. 8 is a top perspective view of the Third Embodiment. A single medial leg (22) is shown extended. Two distal legs (17), forming a "Y", extend outward. This creates an arched, tripartite, monococular Flexible Skateboard Truck. The crown of said truck contains an axle (18). Said truck is mounted to the skateboard deck at one or more possible points (19). The Flexible Skateboard Truck can be constructed integrally with a mass consisting of the same or different materials as said truck.

Figure 9:
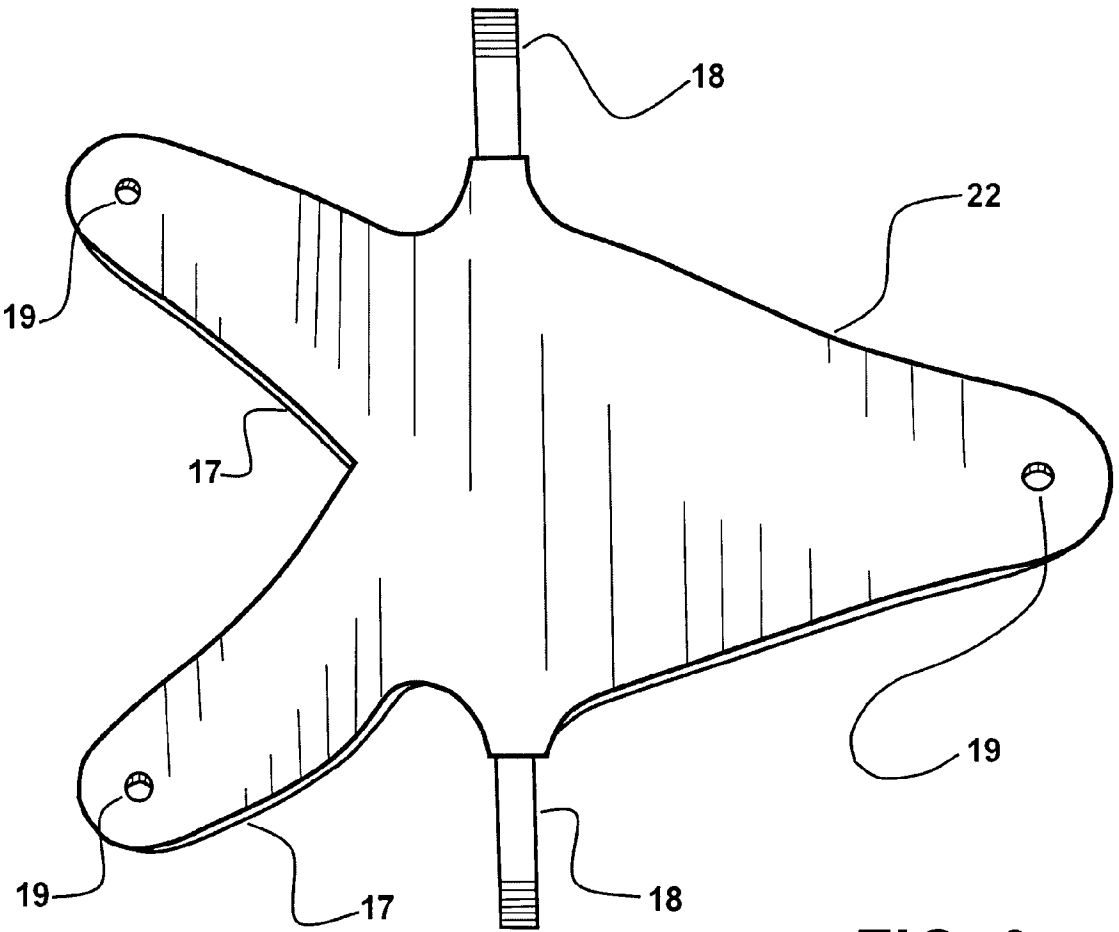
FIG. 9 is a bottom view of Embodiment Three (Reference Number 29) depicting the medial extended leg and two extended distal legs of a skateboard truck.

FIG. 9 is a top view of the Third Embodiment showing possible locations of mounting points (19). A single medial leg (22) is shown extended. Two distal legs (17), forming a "Y", extend outward. This creates an arched, tripartite, monococular Flexible Skateboard Truck. The crown of said truck contains an axle (18). Said truck is mounted to the skateboard deck at one or more possible points (19). The Flexible Skateboard Truck can be constructed integrally with a mass consisting of the same or different materials as said truck.

Figure 10:
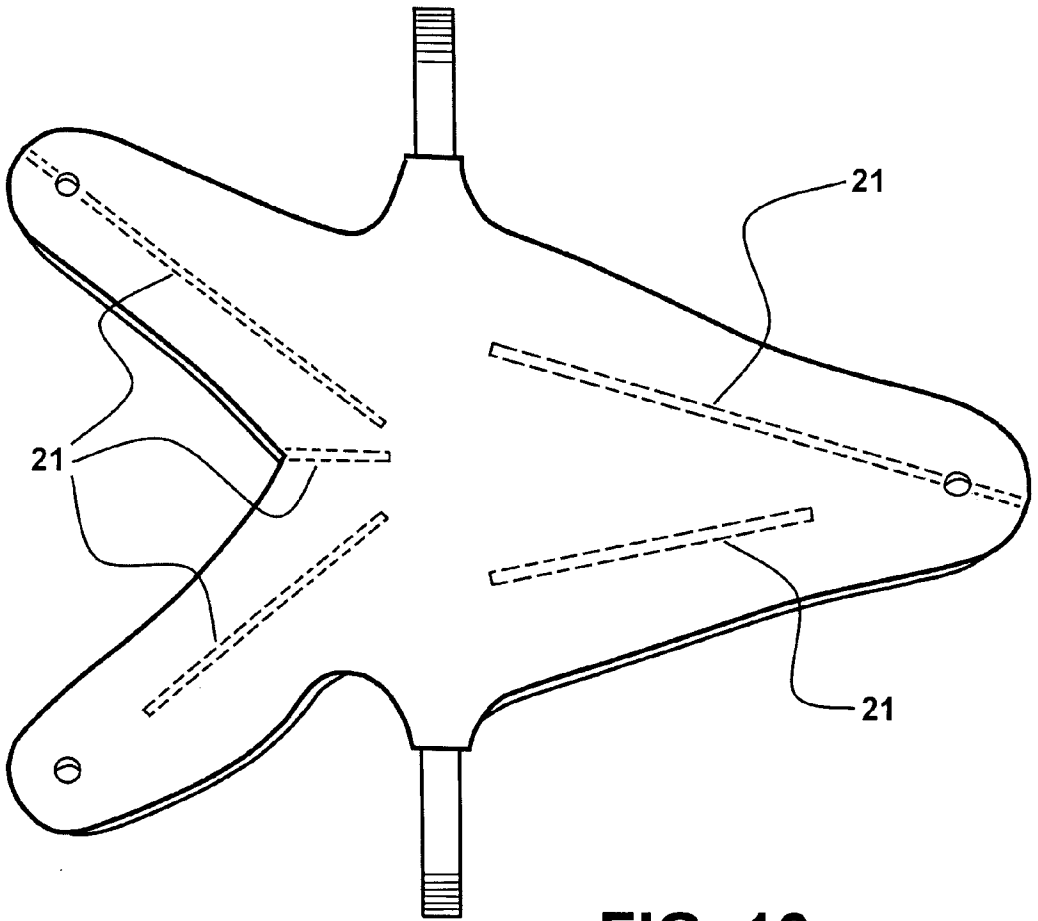
FIG. 10 is a bottom view of Embodiment Three (Reference Number 29) depicting possible slit and/or rib placements in the extended medial and distal legs of a skateboard truck.

FIG. 10 is a bottom view of the Third Embodiment illustrating possible locations of slits and/or ribs (21) shown as doubled, dashed lines. Slits and/or ribs can be introduced in a variety of locations on any one or all embodiments. Said slits and/or ribs can vary in shape, length, width and quantities. A single medial leg (22) is shown extended. Two distal legs (17), forming a "Y", extend outward. This creates an arched, tripartite monococular Flexible Skateboard Truck. The crown of said truck contains the axle. The Flexible Skateboard Truck can be constructed integrally with a mass consisting of the same or different materials as said truck.

Because the operation of all four embodiments is similar, OPERATION is described at the end of this section, DETAILED DECSRIPTIONS.

Figure 11:
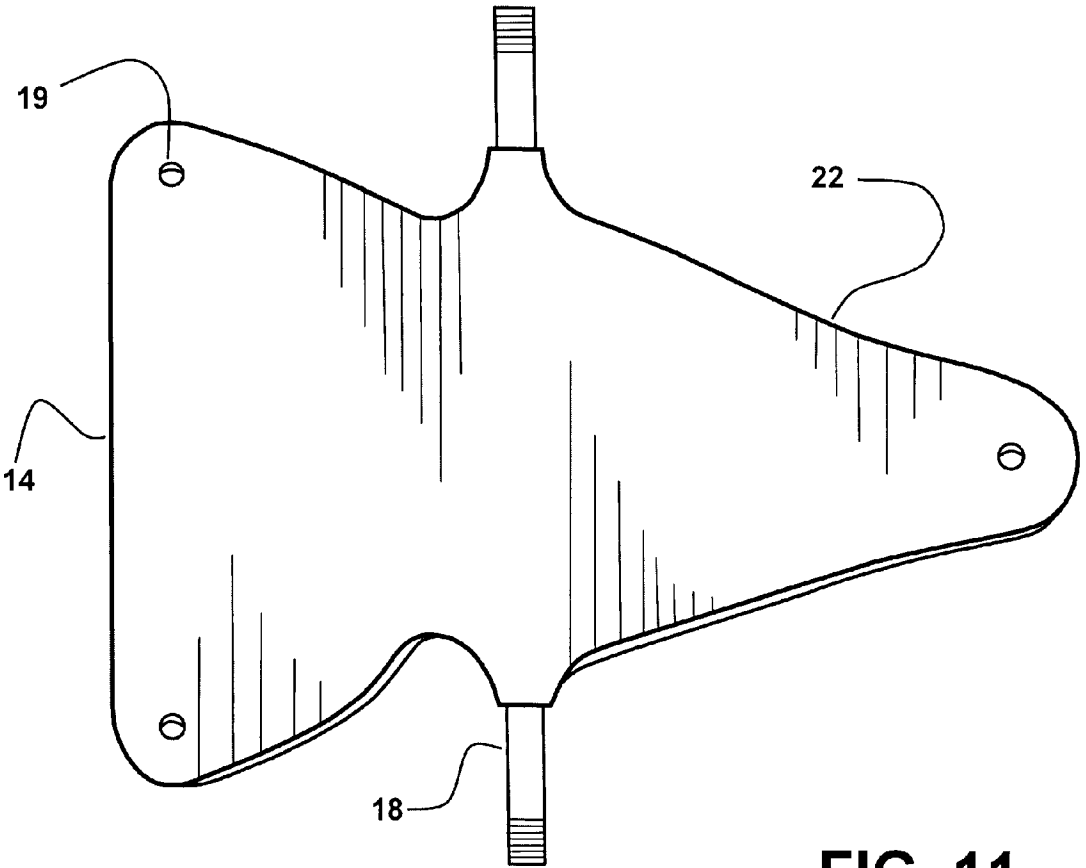
FIG. 11 is a bottom view of Embodiment Four (Reference Number 30) depicting a single, unitary distal leg.

The Fourth Embodiment of the Flexible Skateboard Truck is illustrated in FIG. 1, Number 30 and FIG. 11.

FIG. 11 is a bottom view of the Fourth Embodiment. A distal leg (14) is depicted as a single unit. A single medial leg (22) is shown extended. Said distal leg combined with said medial leg form an arched, monococular Flexible Skateboard Truck. The crown of said truck contains an axle (18). Said truck is mounted to the skateboard deck at one or more possible mounting points (19). The Flexible Skateboard Truck can be constructed integrally with a mass consisting of the same or different materials as said truck.

Because the operation of all four embodiments is similar, OPERATION is described at the end of this section, DETAILED DECSRIPTIONS.

Figure 12:
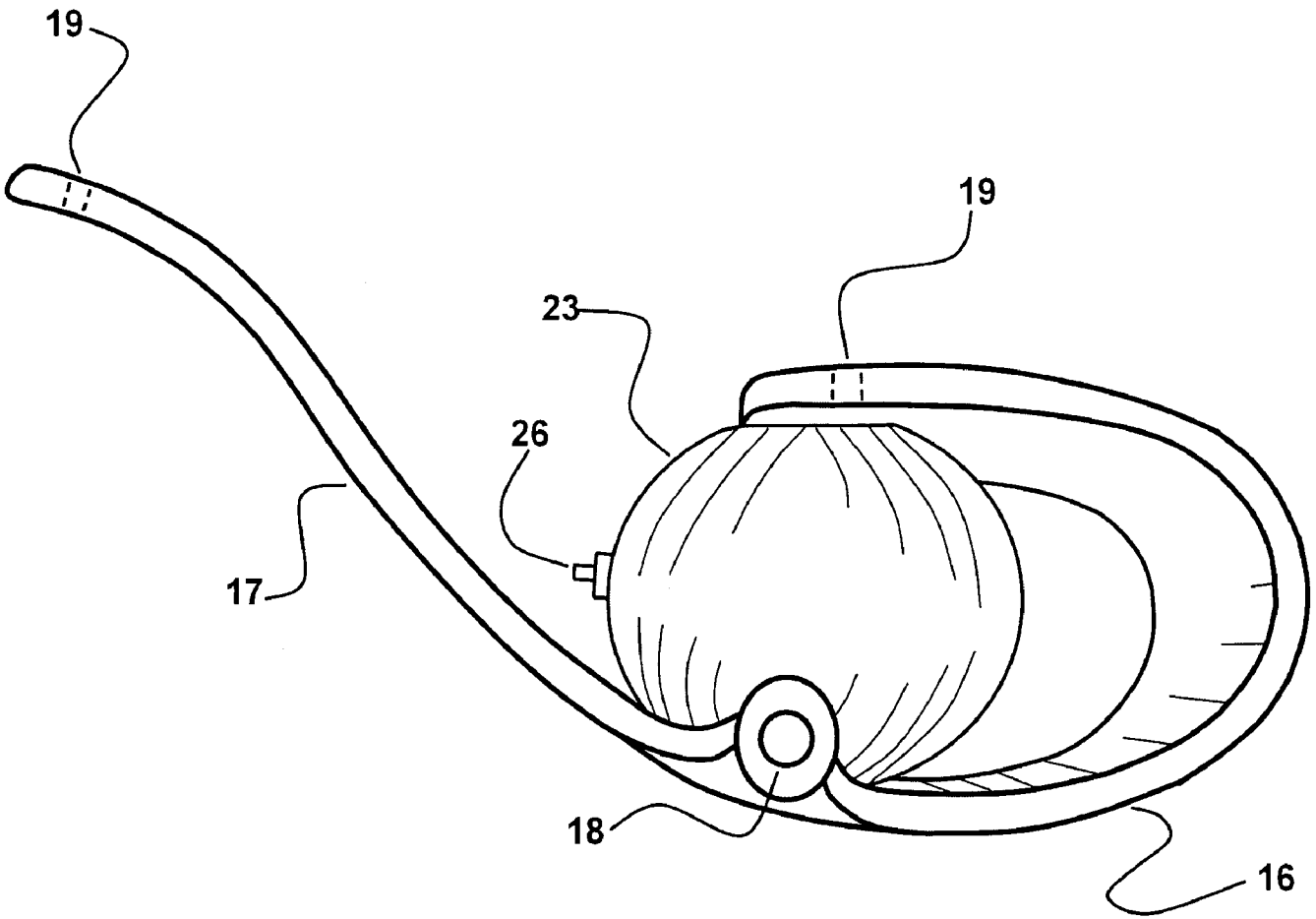
FIG. 12 is a side view depicting a possible placement of an optional pneumatic bladder(s) and valve.

FIG. 12 is a side view of the First Embodiment depicting a pneumatic bladder(s) (23) inserted above the arch of the monococular Flexible Skateboard Truck. Said pneumatic 310 bladder's pressure can either be fixed or varied if fitted with a valve (26). Said pneumatic bladder can be utilized on any embodiment. A single medial leg (16) is shown curved over itself. Distal legs (17) extend outward. This creates an arched, monococular Flexible Skateboard Truck. The crown of said truck contains an axle (18). Said truck is mounted to the skateboard deck at one or more possible mounting points (19).

Figure 13:
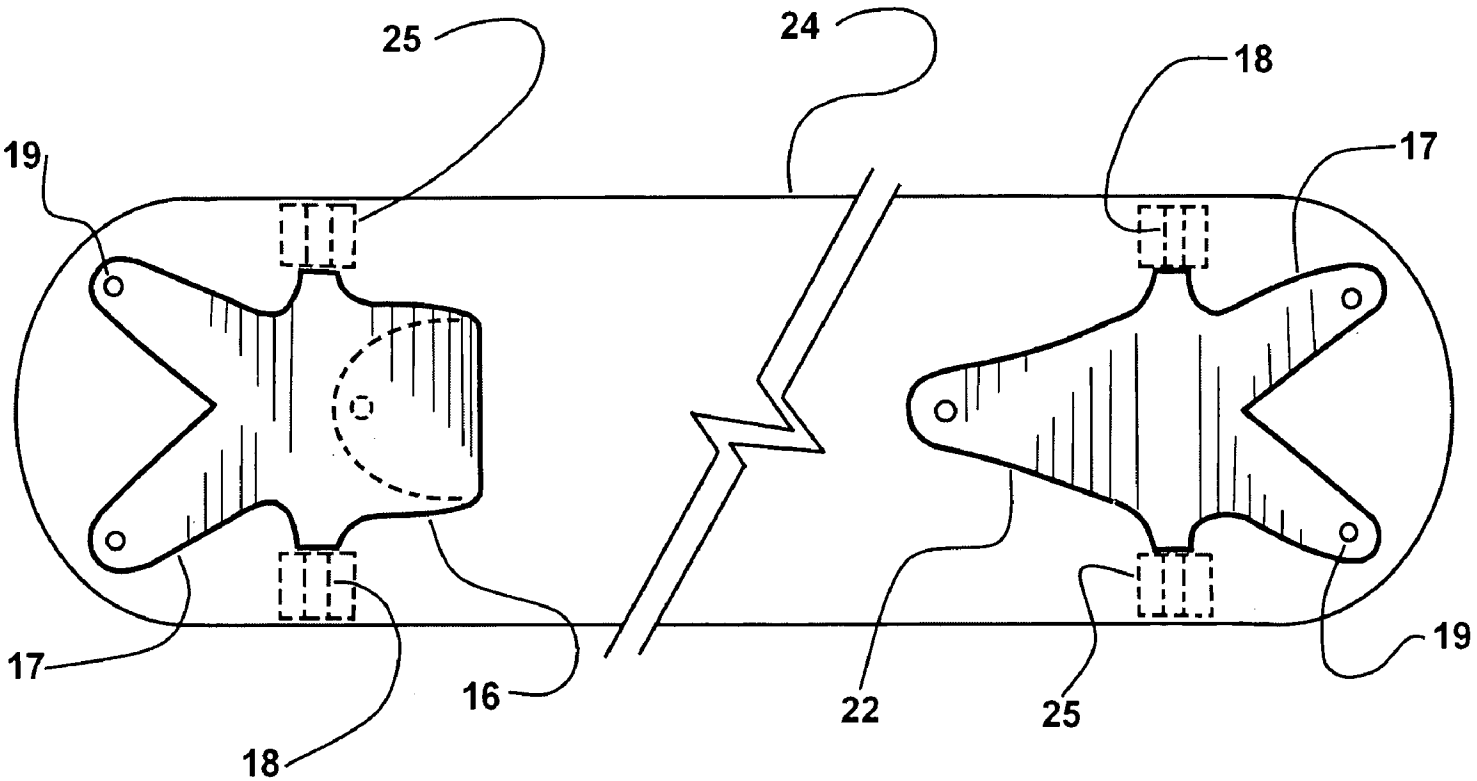
FIG. 13 is a bottom view of a skateboard assembly showing in addition to Embodiment One and Embodiment Three a skateboard deck and wheels.

FIG. 13 is a bottom view of a possible assemblage of Flexible Skateboard Trucks attached to a skateboard deck (24). Wheels (25) are shown attached to axles (18).

Operation

A skateboard deck, supported by the Flexible Skateboard Truck, is steered by shifting weight to one side or the other of said deck misaligning the axles creating an arc defined by the intersection of the axle axes. Said skateboard rotates around this intersection. When the weight of a rider is shifted to the right side of said deck, the two skateboard axles axes form an intersection to the right of the rider causing said skateboard to steer right. The opposite is true if the weight is applied to the left side. Said truck accepts differential pressure applied to various areas of the monococular structure. The differential quantities of stress in each leg enable a dynamic misalignment of axles causing said skateboard to turn.

Energy storage and maneuverability occurs when said truck deforms and stores energy by compressing a portion of the monocoque and extending others. An infinite number of stress combinations are created which are dynamically released by the rider. Said truck stores more energy than a traditional truck. This stored energy can be released in a wider range of motion than a traditional truck. Shock absorption, steering and overall maneuverability are therefore enhanced.

Additional support can be achieved by a fixed or variable pressure pneumatic air bladder(s) positioned along the inside surface of the monocoque.

Although qualitatively different, all embodiments operate in the same manner.

CONCLUSION, RAMIFICATIONS AND SCOPE

Accordingly, the reader can see that a skateboard truck consisting of a single, simple monococular structure has the ability to absorb shock and store energy which allows effective steering and enhanced maneuverability. Furthermore, the Flexible Skateboard Truck has the following advantages:

1. Said truck can be made of various flexible, structural materials including but not limited to composite materials such as laminated carbon fiber, fiberglass, and Kevlar. Spring metal such as steel, titanium or other metal alloys, plastic injected or vacuum molded parts such as nylon, and other plastic materials can be used.
2. Said truck's applications include but are not limited to suspension for motorized and non-motorized vehicles and wheeled and non-wheeled devices. Examples of use on wheeled devices include but are not limited to skateboards, roller skates, and vehicles with chassis such as carts and automobiles. Examples of non-wheeled devices include but are not limited to ice skates, skis, sleds and other apparatus with runners, hydrofoils, pontoons and the like.
3. Said truck has the ability to differentially flex which provides superior shock absorption. Superior shock absorption improves ground control and therefore safety is enhanced. Because of said truck's ability to absorb more shock than a traditional truck, greater speed and a smoother ride can be achieved rolling across rough and/or irregular surfaces.
4. Said truck features an improved ability to absorb shock. The compressive motion of shock absorption acts like a springboard which absorbs and releases energy. This creates more vertical mobility therefore enhancing the rider's ability to perform tricks.
5. Because said truck is able to flex three dimensionally in a wider range of motion, a skateboard rider can, in a more fluent manner, reposition his center of gravity. This results in a more controlled ride which in turn improves safety, tighter turning and overall maneuverability.
6. Said truck can be made stiffer in order to accommodate different riders' weight, physical abilities and riding styles by introducing a pneumatic air bladder(s) which can be of a predetermined, fixed pressure. The pressure can also be varied by utilizing a bladder(s) containing a valve.
7. Said truck can be made less stiff in order to accommodate different riders' weight, physical abilities and riding styles by introducing slits and/or ribs in a wide variety of locations, lengths, widths and shapes. Generally this affects how much force is required to turn the skateboard.
8. Said truck, being a monococular design, can be made lighter in weight and more durable than a traditional skateboard truck assemblage. Furthermore, said truck would be simpler and less costly to manufacture.
9. Said truck can be mounted at one or more points spaced at variable distances. Wider spacing of mounting points stabilizes the ride which in turn allows a rider to control fishtailing especially at high speeds.
10. Said truck can be integrally formed to a skateboard deck at one or more points.
11. The axle of said truck can be constructed integrally with the monocoque during its fabrication or attached after the construction of said monocoque.

Although the description above contains many specificities, these should not be construed as limiting the scope of the embodiments but as merely providing illustrations of some of the presently preferred embodiments. For example, the Flexible Skateboard Truck can be constructed in a variety of shapes and materials. Said truck can be manufactured in a variety of ways including but not limited to laying up reinforcement fiber with plastic resin, plastic injection molding, casting of molten and non-molten compounds, semisolid injection molding, and forming spring metal utilizing mechanical and metallurgical methods. The number of legs can vary as well as the number of mounting points and their relative spacing. Said truck can be constructed integrally with the deck or attached with a wide variety of fasteners. Said monococular truck can be fitted with a pneumatic bladder(s) and/or a variety of slits and/or ribs which will modify said truck's stiffness. Said truck can be used for athletic, recreational, industrial, architectural, scientific, medical, transportation and any application requiring stability, suspension and/or shock absorbing support.

Thus the scope of the embodiments should be determined by the appended claims and their legal equivalents, rather than by the examples given.

I claim:

1. A flexible suspension device for use on a skateboard having a deck and trucks at both ends of said deck, said suspension device comprising:

a flexible monocoque support structure that attaches to the bottom of said deck; said support structure includes a single medial leg and at least one or more distal legs that attach to said skateboard deck;

said support structure further includes a crown section located between said medial and distal legs to contain an axle transverse to said medial and distal legs;

wherein an outer surface of each said one or more distal legs are configured in a non-parallel geometry to each other.

2. The flexible suspension device of claim 1 having an optional bladder placed between said support structure and said skateboard deck.

* * * * *